United States Patent [19]

Bertiller et al.

[11] Patent Number: 4,561,340

[45] Date of Patent: Dec. 31, 1985

[54] TWO-BARREL REVOLVER-TYPE FIREARM

[75] Inventors: Roland Bertiller; Gerd Kellner, both of Schramberg; Bernhard Peter, Rottweil, all of Fed. Rep. of Germany

[73] Assignee: Mauser-Werke Oberndorf GmbH, Fed. Rep. of Germany

[21] Appl. No.: 540,674

[22] Filed: Oct. 11, 1983

[30] Foreign Application Priority Data

Oct. 12, 1982 [DE] Fed. Rep. of Germany ..... 3237728

[51] Int. Cl.[4] ..... F41D 7/04

[52] U.S. Cl. ..... 89/127; 89/155

[58] Field of Search ..... 89/1.41, 33.03, 126, 89/127, 155, 156, 157

[56] References Cited

U.S. PATENT DOCUMENTS

| | | | |
|---|---|---|---|
| 2,950,652 | 8/1960 | O'Brien | 89/126 |
| 2,972,286 | 2/1961 | Marquardt | 89/126 |

FOREIGN PATENT DOCUMENTS

| | | |
|---|---|---|
| 1163197 | 2/1964 | Fed. Rep. of Germany . |
| 2313591 | 10/1974 | Fed. Rep. of Germany . |
| 2142763 | 1/1977 | Fed. Rep. of Germany . |
| 3202462 | 8/1983 | Fed. Rep. of Germany . |

*Primary Examiner*—Stephen C. Bentley

*Attorney, Agent, or Firm*—McGlew and Tuttle

[57] ABSTRACT

A two-barrel revolver-type firearm comprising two fixed barrels to be fired alternately, which are equipped with igniting systems and drives of their own, independent of each other. A drum with an odd number of chambers alternately aligns a chamber with each barrel for alternate firing of cartridges through the two barrels.

11 Claims, 7 Drawing Figures

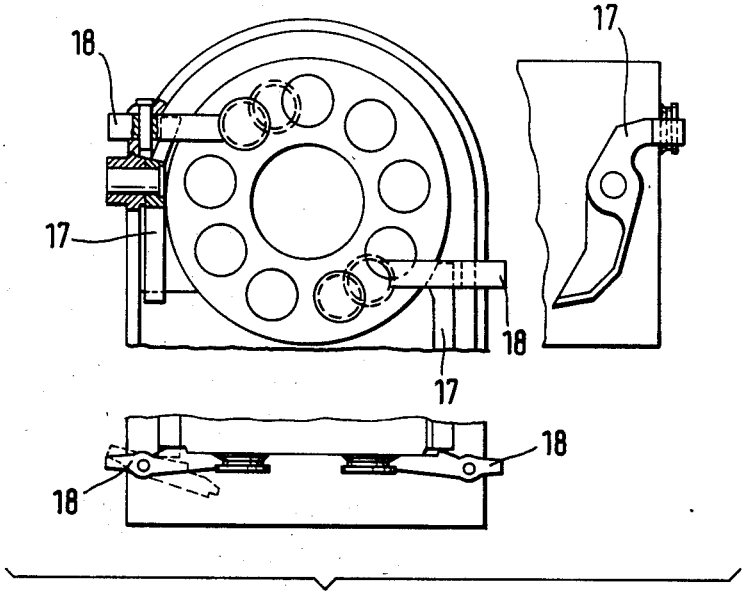
FIG. 4
FIG. 5
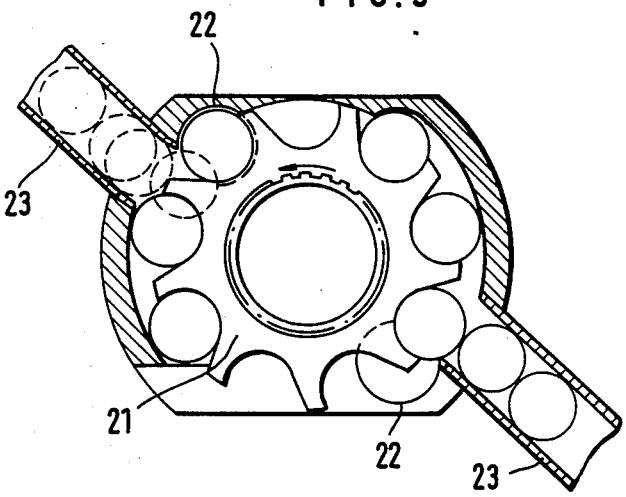

FIG. 6
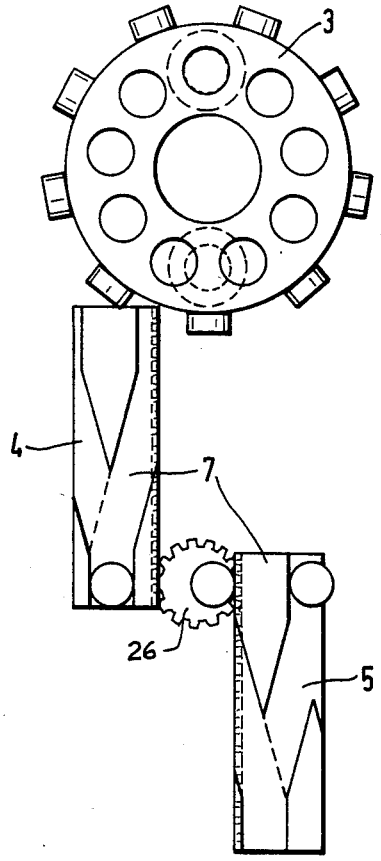
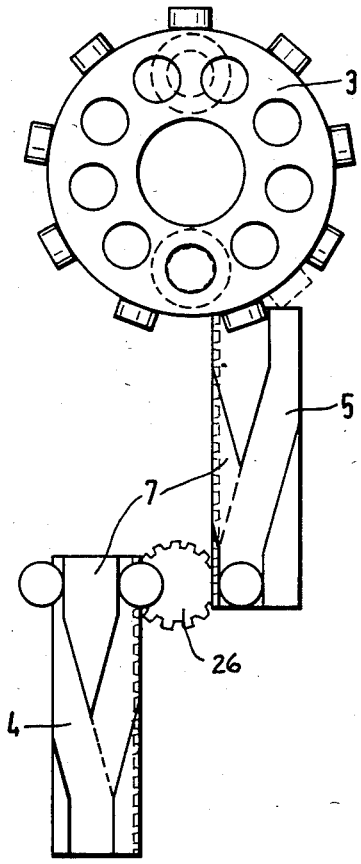
FIG. 7

TWO-BARREL REVOLVER-TYPE FIREARM

FIELD AND BACKGROUND OF THE INVENTION

The present invention relates in general to firearms, and in particular to a new and useful two-barrel revolver-type firearm having a drum with a plurality of cartridge chambers which are alternately alignable with the two barrels for firing cartridges therein.

In accordance with the prior art disclosed by German Pat. No. 21 42 763, revolver-type firearms essentially comprise a revolver drum including a number of cartridge chambers which are circumferentially distributed and, while turning the drum, become consecutively aligned with a barrel, or barrels of the firearm, if a multi-barrel firearm is involved, at the rear thereof. The drum is usually moved by a control slide acting on the drum through curved guides and rollers. A cartridge feeding star wheel of such drum firearms is coaxial with the drum and usually connected thereto through a clutch (see German AS No. 1,163,197).

To increase the firing rate of revolver-type firearms, it has already been proposed to provide, for example, two-barrels, instead of a single barrel. In such two-barrel arms, where the cartridges are ignited simultaneously, disturbances in operation of the firearm may occur due to delays in ignition which cannot be avoided.

Furthermore, the firearm may be destroyed and the user even killed, for example, upon a delayed ignition with the cartridge half extracted. Thus, two-barrel firearms of this type involve a great safety risk.

SUMMARY OF THE INVENTION

The present invention is directed to a firearm of the above mentioned kind having a satisfactory firing rate and in which the mentioned drawbacks are eliminated, while at the same time the reaction forces acting on the supporting structure of the firearm are substantially smaller than in a single-barrel revolver type firearms and the indexing angle of the drum per round is small.

Accordingly, an object of the present invention is to provide a two-barrel revolver type firearm which comprises a drum housing, two barrels fixed and locked with respect to the drum housing, a drum rotatably mounted in the drum housing at the rear of the barrels, a shaft in the drum housing for rotatably supporting the drum which has a plurality of axially extending cartridge chambers that are alignable with the barrels, a cartridge feeder associated with the drum housing for feeding cartridges to the cartridge chambers, an ignition system and a firearm drive system associated with the barrels and drum for supplying cartridges to the barrels in alternating fashion so that the barrels are utilized to fire cartridges alternately.

The ignition systems for the two barrels are independent of each other so that a shot is fired only when the cartridge of a respective barrel has been ignited. Only then the feed of the cartridge for the other barrel is completed. If any delay in ignition occurs, the function of the firearm is interrupted until the ignition takes place and the gas pressure for actuating the indexing slide is built up. Upon misfires, the cartridges may simpley be ejected pyrotechnically, hydraulically or pneumatically.

Another object of the present invention is to provide such a firearm wherein the two barrels are each associated with an indexing slide which is operatively connected with a respective barrel through a piston exposed to a gas pressure through a gas bore or a gas intake tube connected between each barrel and each piston, the indexing slides of the two barrels being positively connected so that they move in sliding opposite directions to rotate the drum.

This design has the advantage of resulting in an exact sequence of motions and control, required for the firing of the arm.

Further, the shaft of the drum may be positively connected to the shaft of the cartridge feeder, and it may, in addition be designed as an expansion element. The drum shaft may thus take up at least a part of the expansion forces. In another development an odd number of uniformly circularly distributed cartridge chambers may be provided in the drum. This is a simple way of insuring that the barrels will be fired alternately, which is needed for a satisfactory operation of the firearm.

In accordance with the invention, the drum housing may be box-shaped, provided with releasable fastening elements, and connected to a guide rail for recoiling therewith. Due to the rigid connection of the drum housing to the guide rail, the indexing slides can be switched by this guide rail. No usually provided additional control slide is needed. Since the instants of reversing the switches must be coordinated with those of the drum, the control unit must conform to the recoil and counterrecoil of the drum and the drum housing. In addition, due to the box shape of the drum housing, the expansion forces occurring during discharge are satisfactorily distributed.

With the inventive firearm, the problem posed above is solved in a simple and advantageous manner. Approximately the same firing rate is obtained as with two single-barrel revolver-type firearms. The weight of the inventive firearm is reduced by one third relative to the weight of two such single-barrel arms of which each has overall dimensions that are only about 10% less than the inventive two-barrel firearm. Further, substantially smaller reaction forces in the supporting structure are obtained, with the inventive arm in its mounted state, than with two single-barrel revolver-type firearms. The indexing angles of the drum per round, and thus the axial forces, are small, which results in a satisfactory hitting rate. Due to the relatively large heat radiating surface of the drum, the cook-off danger is reduced. Also, a high case ejection speed is obtained since the indexing slides have identical speeds in both directions of motion.

A further object of the present invention is to provide a two-barrel revolver-type firearm which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

One embodiment of the invention is shown in the drawings, in which:

FIG. 4 is three correlated views of the cartridge ejecting mechanism with a rear elevation in the center, a side elevation to the right and a top plan to the bottom;

FIG. 5 is a sectional view taken along the line V—V of FIG. 1;

FIG. 6 is a diagrammatical illustration of the indexing slide for the first barrel; and FIG. 7 is a similar diagrammatical illustration for the second barrel.

DESCRIPTION OF THE PREFERRED EMBODIMENT

Figure 1:
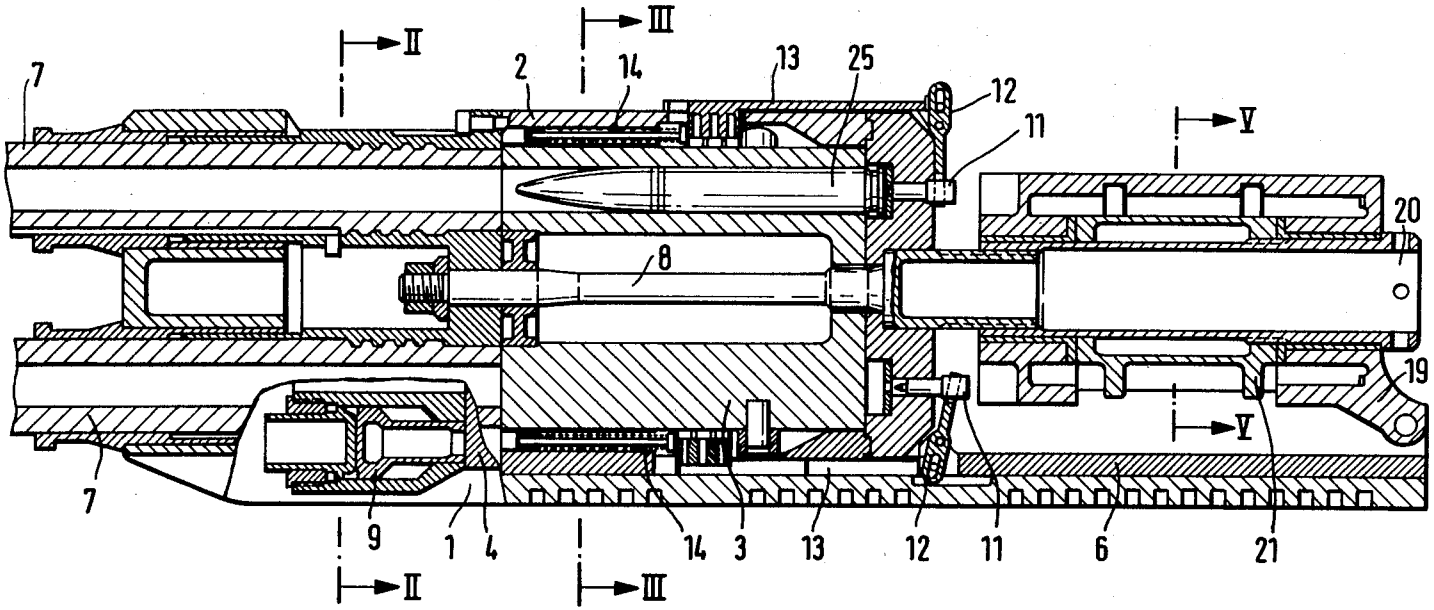
FIG. 1 is a longitudinal sectional view of a two-barrel revolver-type firearm.

The two-barrel revolver-type firearm of the invention as shown in FIG. 1, substantially comprises a receiver 1, a box-shaped weapon or drum housing 2, and two identical barrels 7 which are locked in or to the box-shaped drum housing 2. Drum housing 2 accommodates a drum 3 having, for example, nine cartridge chambers 25 and being mounted for rotation on a drum shaft 8. Drum shaft 8 is designed as an expansion element taking up a part of the expansion forces produced in drum housing 2 upon a cartridge discharge. To ensure an alternate firing from barrels 7, an odd number of cartridge chambers is provided.

Separate cartridges are introduced by a cartridge feeder 19 through a star wheel 21 from two feed sides 23 (FIG. 5) in rear cartridge chamber 22. Star wheel 21 is driven due to a positive engagement between drum shaft 8 and a shaft 20 of the cartridge feeder 19. The cartridges are introduced into cartridge chambers 25 of the drum by means of two indexing slides 4 and 5 (FIGS. 1, 3, 6 and 7). The introduction of a cartridge into its firing position is effected in three steps. The ammunition may be equipped with electrical or mechanical priming elements.

In the following, a mechanical ignition is assumed.

A control slide 13 is tensioned by drum rollers 24 against a trigger spring 14 and locked. Upon pushing the trigger, control slide 13 is accelerated by trigger spring 14. Through the control slide 13 and trigger arm 12, firing pin 11 is accelerated against the primer of the cartridge.

Figure 2:
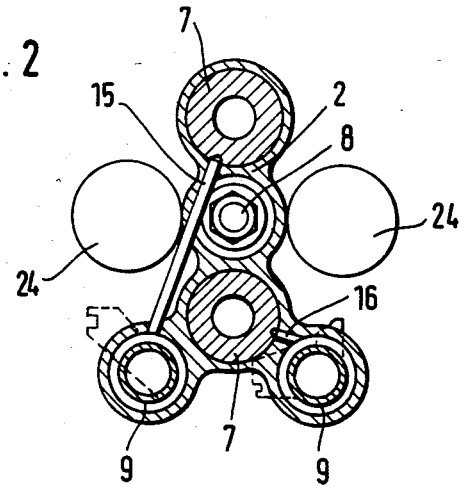
FIG. 2 is a sectional view taken along the line II—II of FIG. 1.

Gas piston 9 is driven by gas pressure through a gas intake tube 15 (FIG. 2). Piston 9 accelerates indexing slide 4 rearwardly. Due to a positive connection between indexing slides 4 and 5, shown schematically at 26, slide 5 is moved forwardly (FIGS. 6 and 7). In FIGS. 6 and 7, the drum 3 is shown in front elevation while slides 4 and 5 are shown in top plan view.

After ignition in the upper barrel 7, drum 3 is turned by the curved guides of indexing slides 4 and 5 through half a division only (that is one half the pitch or spacing of chambers 25). This brings a cartridge chamber 25 into alignment with lower barrel 7. Barrels 7,7 are shown in dotted lines in FIGS. 6 and 7. Again the ignition is effected as described above. Due to control elements engaging slides 4,5 with triggering means 11,12,13,14, the ignition can take place only if indexing slides 4,5 are in their front zero region. Indexing slide 5 is driven through gas piston 9 by the gas acting through gas bore 16 from lower barrel 7.

The cases or misfired cartridges are ejected by ejectors 18 which are driven by ejector lever 17. Elector levers 17 are actuated by indexing slides 4 and 5.

The switches of indexing slides 4,5 are reversed in guide rail 6, so that an additional control slide is not needed.

Guide rail 6 is rigidly connected to drum housing 2 wherefore it follows the recoil thereof. The recoil and counterrecoil of the two-barrel firearm is controlled through two hydraulic recoil and counterrecoil mechanisms.

Only receiver 1 and cartridge feeder 19 are fixed parts of the firearm. All the other parts recoil.

Barrels 7 extend one above the other. To be able to fire them alternately and thus ensure a satisfactory operation, an odd number of cartridge chambers 25 must be provided in drum 3. A simultaneous firing of cartridges would always entail some ignition delay in one of them. In the described embodiment, it is assumed that 9 cartridge chambers 25 are provided. The introduction of cartridges into the chambers includes two feed and rotary movements in cartridge feeder 19, and one rotary motion for drum 3 ahead.

Figure 3:
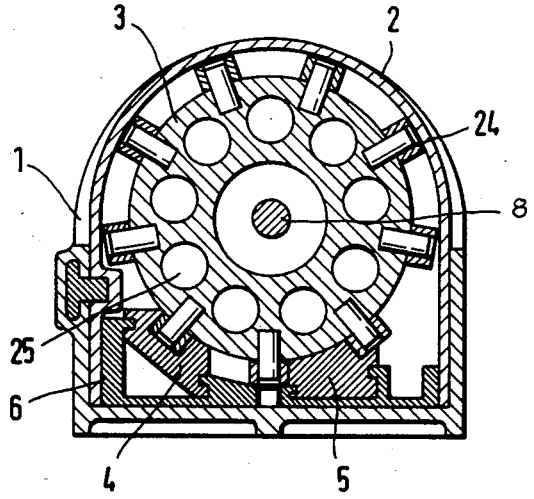
FIG. 3 is a sectional view taken along the line III—III of FIG. 1.

Drum 3 is indexed through the two indexing slides 4 and 5 which are positively connected to each other by means of tooth elements (FIG. 3). Each indexing slide, 4,5 is associated with one of barrels 7 and with a gas drive (piston 9) of its own, so that advantageously a gas admission control is not needed. At every discharge, the drum 3 turns through only half a division, i.e. through about 20°, so that the acceleration and deceleration forces are kept low. The mentioned positive connection between indexing slides 4,5 results in a high case ejection speed.

Receiver 1 of the inventive firearm is substantially only a cradle receiving the barrels 7 and the drum unit, and fixing the cartridge feeder 19.

An example of the means for sliding slides 4 and 5 in opposite directions and at the same time, is gear 26 which meshes with racks defined on slides 4 and 5.

Additional details for the mechanical ignition 11, 12, 13 and 14, can be found in German OS No. 32 02462A1, to the assignee of the present application, which was published on Aug. 11, 1983.

As noted above the ignition mechanism includes control slide 13 which is slidably mounted to the drum or weapon housing 2 and which is biased by a trigger spring 14 which pushes a rod which in turn pushes the control slide 13 to the right as shown in FIG. 1. This however is only after a triggering mechanism (not shown) releases the rod which is biased by triggering spring 14. Release of this rod quickly pushes slide 13 to the right which in turn rotates trigger arm 12. This moves firing pin 11 to the left, igniting a cartridge in the cartridge chamber 25. Control slide 13 is provided with a cam surface which cooperates with rollers 24 as drum 13 rotates. This pushes the control slides 13 back (to the left as shown in FIG. 1) which in turn pushes the rod biased by triggering spring 14 which can then be grabbed by the triggering mechanism and held until the drum rotates to bring another cartridge chamber 25 into alignment with the bore or barrel 7.

While a specific embodiment of the invention has been shown and described in detail to illustrate the application of the principles of the invention, it will be understood that the invention may be embodied otherwise without departing from such principles.

We claim:

1. A multi-barrel revolver-type firearm, comprising:

a weapon housing;

two spaced apart barrels fixed to said housing, each barrel having a through bore for discharging a projectile;

a drum rotatably mounted in said housing having an odd number of axially extending equally circumferentially spaced cartridge chambers therein said cartridge chambers being distributed uniformly in a circle on said drum so that only a single cartridge chamber can be aligned with one of the through bores of said barrels at a time with rotation of said drum;

cartridge feed means connected to said housing for feeding a cartridge to each of said cartridge chambers;

ignition means connected to said housing and associated with each of said two barrels for igniting a cartridge disposed in a cartridge chamber aligned with a through bore of each respective one of said barrels, said ignition means for each barrel being operable independently of each other;

drum drive means connected to said housing and engaged with each of said barrels for rotating said drum only upon ignition of a cartridge in a specific cartridge chamber aligned with a through bore of one of said barrels at a time, said drum drive means associated with each of said ignition means for igniting a cartridge in the specific cartridge chamber, said drum drive means comprising a pair of indexing slides slidably mounted in said drum housing, one indexing slide operatively connected to each of said barrels, gas driver means connected to each slide for driving each indexing slide one at a time in alternating fashion, said indexing slides being positively connected to each other for reciprocal dependent and opposite motion so as to slide in alternating fashion.

2. A firearm according to claim 1, including a drum shaft connected in said housing for rotatably supporting said drum, said cartridge feed means comprising a cartridge feeder having a cartridge feeder shaft fixed to said drum shaft.

3. A firearm according to claim 2, wherein said drum shaft comprises an expansion element for accommodating relative motion between said housing and said cartridge feed means.

4. A firearm according to claim 1, including a guide rail forming a fixed frame of reference, said housing reciprocally mounted for sliding movement on said guide rail.

5. A firearm according to claim 1, wherein said housing is box-shaped.

6. A two-barrel revolver-type firearm, comprising:

a drum housing;

two spaced apart barrels fixed to said drum housing, each barrel having a through bore for discharging a projectile;

a drum rotatably mounted in said drum housing having a plurality of axially extending circumferentially spaced cartridge chambers therein each selectively alignable with one through bore of one of said two barrels with rotation of said drum;

cartridge feed means connected to said drum housing for feeding a cartridge to each of said cartridge chambers;

ignition means connected to said drum housing and associated with each of said two barrels for igniting a cartridge disposed in a cartridge chamber aligned with a through bore of each respective one of said barrels, said ignition means for each barrel being operable independently of each other;

drum drive means connected to said drum housing and engaged with each of said barrels for rotating said drum only upon ignition of a cartridge in a specific cartridge chamber aligned with a through bore of one of said barrels at a time, said drum drive means associated with each of said ignition means for igniting a cartridge in the specific cartridge chamber, said drum drive means comprising a pair of indexing slides slidably mounted in said drum housing, one indexing slide operatively connected to each of said barrels, piston means connected to each slide and communicating with a through bore of each barrel for driving each indexing slide in alternating fashion, said indexing slides being positively connected to each other for reciprocal dependent and opposite motion.

7. A firearm according to claim 6, including a drum shaft connected in said drum housing for rotatably supporting said drum, said cartridge feed means comprising a cartridge feeder having a cartridge feeder shaft fixed to said drum shaft.

8. A firearm according to claim 7, wherein said drum shaft comprises an expansion element for accommodating relative motion between said drum housing and said cartridge feed means.

9. A firearm according to claim 6, wherein said drum includes an odd number of cartridge chambers distributed circumferentially and uniformly in a circle on said drum so that only a single cartridge chamber can be aligned with one of the through bores of said barrels at a time with rotation of said drum.

10. A firearm according to claim 6, including a guide rail forming a fixed frame of reference, said drum housing reciprocally mounted for sliding movement on said guide rail.

11. A firearm according to claim 6, wherein said drum housing is box-shaped.

* * * * *